US005590822A

United States Patent [19]

Zuckerman

[11] Patent Number: 5,590,822

[45] **Date of Patent: *Jan. 7, 1997**

[54] GARMENT HANGER INFORMATION TAB

[75] Inventor: Andrew M. Zuckerman, Forest Hills, N.Y.

[73] Assignee: Different Dimensions Inc., Rego Park, N.Y.

[ * ] Notice: The term of this patent shall not extend beyond the expiration date of Pat. No. 5,407,109.

[21] Appl. No.: 373,746

[22] Filed: Jan. 17, 1995

Related U.S. Application Data

[63] Continuation of Ser. No. 121,266, Sep. 14, 1993, Pat. No. 5,407,109.

[51] Int. Cl.[6] ..... A41D 27/22; G09F 3/00

[52] U.S. Cl. ..... 223/85; 40/322

[58] Field of Search ..... 223/88, 85, 92, 223/95; 24/113, 562, 561, 545, 555, 557; D6/315; 40/322

[56] References Cited

U.S. PATENT DOCUMENTS

| | | | |
|---|---|---|---|
| D. 192,845 | 5/1962 | Cohen . | |
| D. 245,066 | 7/1977 | Taub . | |
| D. 295,195 | 4/1988 | Stoddard . | |
| D. 311,426 | 10/1990 | Ytter . | |
| D. 344,764 | 3/1994 | Tam . | |
| 2,601,026 | 6/1952 | Jones . | |
| 3,013,654 | 12/1961 | Hoff . | |
| 3,534,777 | 10/1970 | Loof . | |
| 3,949,914 | 4/1976 | Ostroll | 223/85 |
| 3,962,758 | 6/1976 | Knappe et al. . | |
| 4,006,547 | 2/1977 | Samuels et al. | 223/85 |
| 4,019,272 | 4/1977 | Kerz . | |
| 4,101,059 | 7/1978 | Batts et al. | 223/85 |
| 4,115,940 | 9/1978 | Phillips | 40/322 |
| 4,839,947 | 6/1989 | Cohen et al. . | |
| 4,997,114 | 3/1991 | Petrou | 223/85 |
| 5,096,101 | 3/1992 | Norman et al. . | |
| 5,159,730 | 11/1992 | Radvin . | |
| 5,199,608 | 4/1993 | Zuckerman | 223/85 |

*Primary Examiner*—C. D. Crowder
*Assistant Examiner*—Bibhu Mohanty
*Attorney, Agent, or Firm*—Amster, Rothstein & Ebenstein

[57] ABSTRACT

In a garment hanger information tab for use on a garment hanger having a tab holder, the tab holder including a ledge, the tab defines a U-shaped body having a top wall, first and second sides, and first and second legs disposed between said sides and defining a slot and an internal channel therebetween. The body has first and second internal fingers extending inwardly from respective legs in the channel, the first and second fingers extending under the ledge of the tab holder to lock the body on the tab holder when the body is on the tab holder. The body is structurally bilaterally asymmetrical about at least one of two mutually perpendicular planes, both of the planes being non-parallel to said top wall, whereby opposite side-to-side orientations of the tab may be distinguished.

12 Claims, 3 Drawing Sheets

FIG. 2
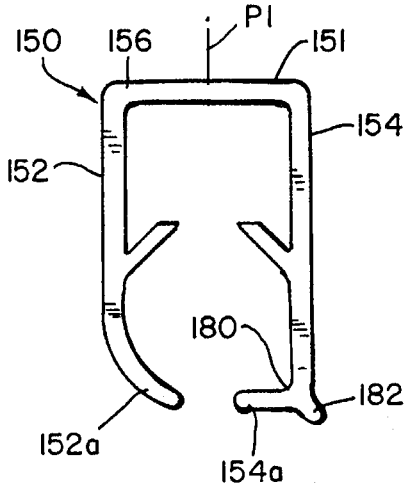
FIG. 3
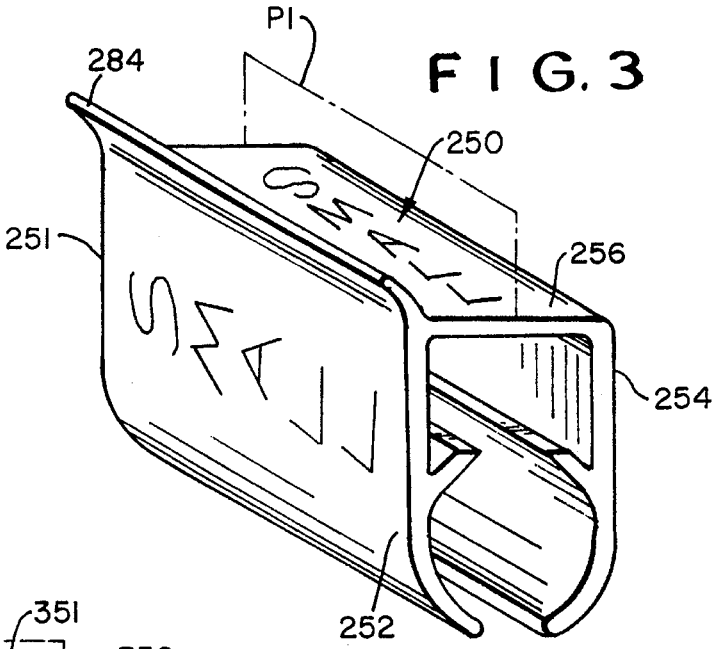
FIG. 4
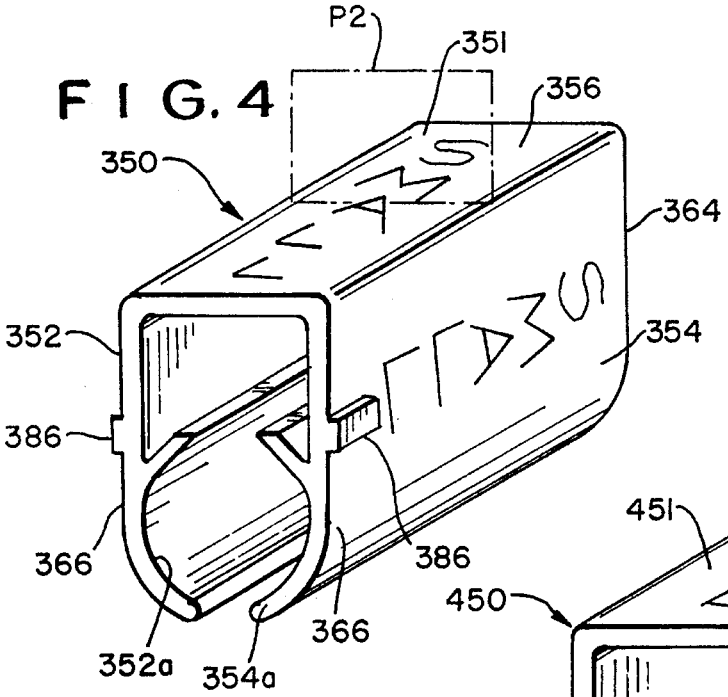
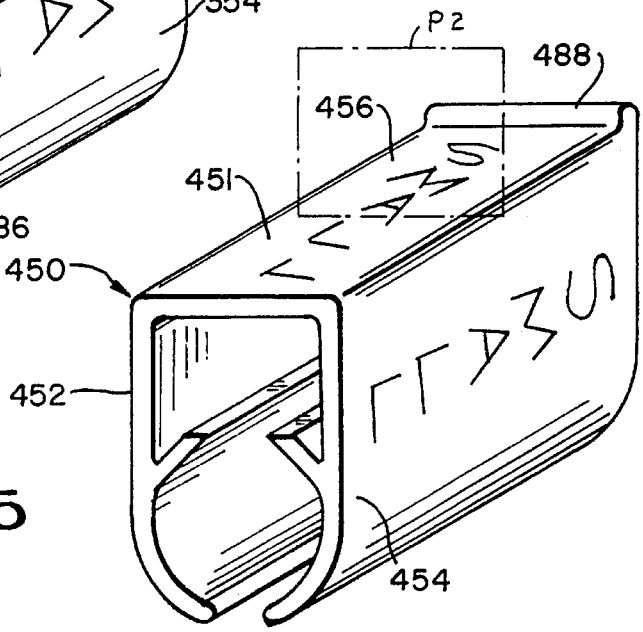
FIG. 5

GARMENT HANGER INFORMATION TAB

This is a continuation of application Ser. No. 08/121,266 filed on Sep. 14, 1993 now U.S. Pat. No. 5,407,109.

BACKGROUND OF THE INVENTION

The present invention relates to a garment hanger information tab for use on a garment hanger having a tab holder, and more particular to such a tab which has a proper side-to-side orientation and an improper side-to-side orientation.

U.S. Pat. No. 5,076,101 discloses a garment hanger information tab for use on a garment hanger having a tab holder including a ledge. The tab defines a generally U-shaped body having a top wall, first and second sides, and first and second legs disposed between the sides and defining a slot and an internal chamber therebetween. The body has first and second internal fingers extending inwardly from respective legs in the channel, the first and second fingers extending under the ledge of the tab holder to lock the body on the tab holder when the body is on the tab holder. The illustrated tab holder is structurally bilaterally symmetrical about two mutually perpendicular planes, both of the planes being non-parallel (and in fact perpendicular) to the top wall. Thus the tab is rapidly and easily grasped and attached to the garment hanger without regard to the side-to-side orientation in which it will be placed thereon.

The tabs are intended to convey information to a potential customer and typically include information regarding the clothing on the garment hanger, most typically its size—e.g., S or small, M or medium, L or large, or size numbers. Where the single letter "S" is used on the tab, when the S is readable in one side-to-side orientation of the tab, it is equally readable in the opposite side-to-side orientation. However, this does not apply to the letters "M" or "L" and certainly not to the words "small," "medium," or "large," or to size numbers. Due to the space limitation on the tab, the words typically do not extend horizontally (that is, left end to right end) but rather vertically (that is, from top side to bottom side where the top is one side and the bottom is the opposite side). Such tabs generally operate satisfactorily for their intended use once they have been properly inserted on the hanger.

However, it is frequently the case that tabs are applied to hangers in the wrong side-to-side orientation so that the information printed on the tab cannot be properly read. While this presents only a minor problem which the well-motivated customer can overcome in most instances, in other instances—such as where the indicated size is a "6" or "9"—a major problem may result. Further, if the tab is to be applied by automated machinery, which selects a tab from a storage pool of randomly oriented tabs for the same size, the low-level inexpensive equipment preferably used for such a task cannot recognize or "read" words or numbers written on the tab and therefore will be unable to appropriately orient the tab on the hanger. Because of this problem, the tabs are typically applied manually, at a much greater cost. However, even with manual placement of the tabs they often end up in the wrong orientation.

Accordingly, it is an object of the present invention to provide a garment hanger information tab wherein the opposite side-to-side orientations of the tab may be distinguished.

Another object is to provide such a tab which will seat on the tab holder only in a predetermined side-to-side orientation.

A further object is to provide such a tab which is inexpensive to manufacture and use.

It is also an object of the present invention to provide in combination such a tab and a hanger.

SUMMARY OF THE INVENTION

It has now been found that the above and related objects of the present invention are obtained in a garment hanger information tab for use on a garment hanger having a tab holder where the tab holder includes a ledge. The tab comprises a U-shaped body having a top wall, first and second sides, and first and second legs disposed between the sides and defining a slot and an internal channel therebetween. The body has first and second internal fingers extending inwardly from respective legs in the channel, the first and second fingers extending under the ledge of the tab-holder to lock the body on the tab holder when the body is on the tab holder. The body is structurally bilaterally asymmetrical about at least one of two mutually perpendicular planes, both of the planes being non-parallel to the top wall, whereby opposite side-to-side orientations of the tab may be distinguished.

In a preferred embodiment, the first and second legs include free ends, the free ends of the legs extending inwardly to define a gap therebetween. The top wall and/or legs are structurally bilaterally asymmetrical about at least one of the two mutually perpendicular planes, and preferably the body is structurally bilaterally asymmetrical about both of the two mutually perpendicular planes. Both of the planes are preferably perpendicular to the top wall.

In another preferred embodiment, the bilateral asymmetry enables the first and second fingers to extend under the ledge of the tab holder to lock the body on the tab holder only when the tab is in a predetermined one of the opposite orientations. The top wall is structurally bilateral asymmetrical about at least one of two mutually perpendicular planes, both of the planes being non-parallel to the top wall. The tab holder defines at least a partial recess for receiving the top wall, the top wall being configured and dimensioned to be received within the recess only when the tab is in a predetermined one of the opposite orientations.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 2 is a side elevational view of a tab according to the first embodiment of the present invention;

FIGS. 3–5 are isometric views of tabs according to the second-fourth embodiments of the present invention, respectively.

DETAILED DESCRIPTION OF THE PREFERRED EMBODIMENTS

Figure 1:
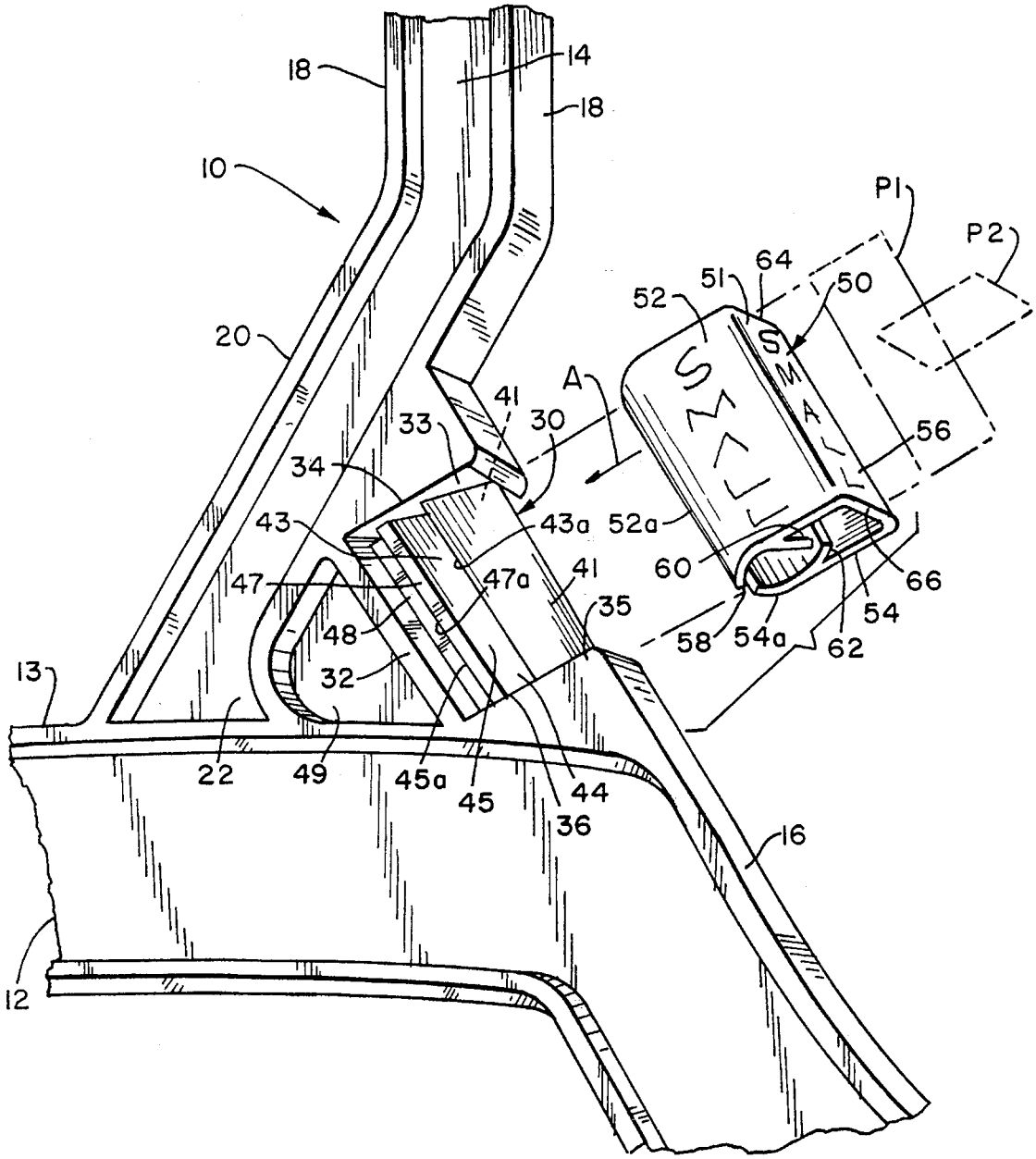
FIG. 1 PRIOR ART
FIG. 1 is an exploded isometric view of a conventional tab and hanger combination.

Referring now to the drawing, and in particular to FIG. 1 thereof, therein illustrated is a conventional garment hanger, generally designated by the reference 10, and a conventional information tab, generally designated 50, for use therewith as set forth in the aforementioned U.S. Pat. No. 5,096,101.

Hanger 10 is preferably molded from a thermoplastic material and includes a hanger body 12 having a hook member 14 joined thereto or molded therewith. Hanger body 12 is generally planar and has a transverse reinforcing wall or rib 16 forming an I-beam construction extending around its periphery. Similarly, hook member 14 is generally planar and includes a transverse reinforcing wall or rib 18 extending around its periphery. Hook member 14 has a base section 20 extending at an angle to hanger body 12 which includes a widened section 22 at the position where hook member 14 joins shoulder 13 of hanger body 12.

Hanger 10 includes a tab mounting member or tab holder 30 which extends intermediate shoulder 13 of hanger body 12 and angled base section 20 of hook member 14. In a preferred embodiment, the holder 28 is integrally molded with hanger 10. It is noted, however, that tab holder 28 need not be integrally formed and may be positioned at other places on hanger 10, such as on hook 14.

Tab holder 30 is generally configured in a rectangular shape extending in the space between rib 16 of body 12 and rib 18 of hook 14. Tab holder 30 terminates below at a rib 32 also having an I-beam configuration. The sides 34 and 36 of tab holder 30 are formed by walls 33 and 35 extending below a cut-out region 38 in rib 16.

Tab holder 30 includes an upper enlarged region 40 which is triangular in cross-section to form a first arrow-head shape. Region 40 is defined by sloping sidewalls 41, and a base 43 having a pair of opposing ledges **43*a*. A lower enlarged region 44 is formed below region 40 and is also triangular in cross-section to form a second arrow-head shape. Region 44 is defined by sloping sidewalls 45 which terminate in lateral portions 45*a*, and a base 47 having a pair of opposing ledges. A thin wall 48 extends from base 47 of region 44 to rib 32. A second thin wall 49 extends from rib 32 to ribs 16, 18. Tab holder 30 is adapted to receive and secure information tab 50**.

Information tab 50 is preferably formed from a resilient thermoplastic material as a plastic extrusion. Information tab 50 has a body 51 which is generally U-shaped in cross-section and includes opposing legs 52 and 54 extending from a top wall 56 upon which information, such as the size of a garment, is disposed. The ends **52*a* and 54*a* of legs 52 and 54, respectively, are curved inwardly as depicted to define a gap 58. Tab 50 also includes inwardly extending resilient projections in the form of fingers 60 and 62 which extend from the inside walls forming legs 52 and 54, respectively, toward top wall 56**.

While information, such as the size of a garment, is typically disposed on the top wall 56, it may alternatively, or in addition thereto, be disposed on one or both of the legs 52, 54. It will be appreciated that the information (e.g., "small") is typically written from one side of the top wall 56 or legs 52, 54 (i.e., side 34 of tab holder 30), to the other side thereof (i.e., side 36 of tab holder 30) so that the side-to-side orientation of the tab is a significant factor in determining whether or not the information is properly oriented for easy reading.

Information tab 50 is inserted on tab holder 30 in the direction of arrow A. Curved ends **52*a* and 54*a* of legs 52 and 54 will spread apart upon contact with sidewalls 41 of region 40 and will spread apart again upon contact with sidewalls 45 of region 44. After passing lateral portions 45*a*, curved ends 52*a* and 54*a* will abut against thin wall 48. At the same time, fingers 60 and 62 will be forced towards legs 52 and 54, respectively, as they ride over sloped sidewalls 41. Once fingers 60 and 62 pass beyond sidewalls 41, they move inwardly towards their normal position and lock under ledges 43*a* of base 43. Fingers 60 and 62 rest against sidewalls 45 of region 44**.

Due to the inward curved construction of the ends of legs 52 and 54 which bear against wall 48 and rib 32 (which impedes access to free ends **52*a*, 54*a*), and the resilient fingers 60 and 62 locking under base 43**, a secure locking system is provided. The tab is essentially locked on the tab holder and is therefore child-proof. The same construction could be provided on the hook of the hanger body to provide a secure locking of the tab on the hook itself.

It will be appreciated that the fingers 60 and 62 are not necessarily resilient, as a resilient top wall 56 may be sufficient to enable adequate spreading of the legs 52, 54 for them to pass over the sidewalls 41 and 45 and then engage thin sidewall 48, and to enable adequate spreading of the fingers 60 and 62 for them to pass over the sidewalls 41 and then engage base 43 below the opposing ledges **43*a***.

Turning now to the novel aspects of the present invention, the tab according to the present invention is structurally bilaterally asymmetrical about at least one (and optionally both) of two mutually perpendicular planes, both of the planes being non-parallel (and preferably perpendicular) to the top wall 56, so that opposite side-to-side orientations of the tab 50 may be distinguished. By way of contrast, it will be appreciated that the conventional tab 50 illustrated in FIG. 1 is structurally bilaterally symmetrical about both planes P1 and P2 where plane P1 bisects top wall 56 lengthwise and passes generally parallel to legs 52, 54 between fingers 60, 62 and through gap 58, and where plane P2 bisects legs 52, 54 and the shorter dimension of top wall 56. The term "structurally" bilaterally symmetrical or asymmetrical is used to indicate that the symmetry or lack thereof is to be judged independently of the information contained on the tab regardless of whether that information is merely printed on the tab or is of unitary, one-piece, integral construction therewith formed in a single operation (for example, by having the information created in raised form thereon during the tab-molding process).

Referring now to FIG. 2, therein illustrated is a first preferred embodiment 150 of a tab of the present invention which is structurally bilaterally asymmetrical about the plane P1. Tab 150 has a tab body 151 which is substantially identical to conventional tab 50 except that, while leg 152 is inwardly curved at its free end **152*a* (as in conventional tab 50), leg 154 defines an inwardly extending, generally right angle 180 at its free end 154*a*. The opposite side-to-side orientations of the tab 150 are easily distinguished as having either the curved free end 152*a* or the right angle free end 154*a* on a predetermined side. The appropriate predetermined side will, of course, be determined as the side which enables suitable reading of the information disposed side-to-side on the top wall 151 or the legs 152, 154 of the tab 150. While most people can easily distinguish between a curved free end 152*a* and a right angle free end 154*a*, if desired the right angle free end 154*a* may additionally be provided with a downwardly and outwardly projecting spur 182** which preferably bisects the obtuse angle and provides an additional point of structurally bilateral asymmetry about plane P1.

Tab 150 is only illustrative of the wide variety of different mechanisms by which a body may be made structurally bilaterally asymmetrical about plane P1 by making the two legs 152, 154 distinguishable from one another while leaving the top wall 156 bilaterally symmetrical about the plane P1.

Referring now to FIG. 3, therein illustrated is a second embodiment 250 of the tab according to the present invention wherein (as in tab 150) the tab body 251 is structurally bilaterally asymmetrical about the plane P1. In this tab 250, the legs 252, 254 depending from top wall 256 are bilaterally symmetrical about the plane P1, but the top wall 256 includes an upwardly and outwardly extending spur 284 extending from side-to-side along leg 252 (but not the other leg 254), so that the top wall 256 is structurally bilaterally asymmetrical about the plan P1. This embodiment also enables opposite side-to-side orientations of the tab 250 to be easily distinguished.

Alternatively, opposite side-to-side orientations of the tab may be made distinguishable by a tab body which is structurally bilaterally asymmetrical about the plane P2. Referring now to FIG. 4, therein illustrated is a third embodiment 350 of the tab according to the present invention. The tab body 351 includes a top wall 356 and a pair of legs 352, 354 depending from the top wall 356. Each leg end **352*a*, 354*a* defines on the outer surface thereof adjacent one side 364, 366 (side 366 as illustrated in FIG. 4) an outwardly projecting lug 386. The presence of the lugs 386 adjacent side 366 of the legs 352, 354 renders the two sides 364, 366 structurally dissimilar so that the tab 350** is structurally bilaterally asymmetrical about the plane P2.

While tab 350 illustrates a tab having a structural bilateral asymmetry on its legs 352, 354, the asymmetry may alternatively, or in addition thereto, be disposed on the top wall. Thus, referring now to FIG. 5, therein illustrated is a fourth embodiment 450 of the tab according to the present invention. The tab body 451 defines a top wall 456 and a pair of depending legs 452, 454. The top wall 456 defines a raised lug 488 (illustrated in FIG. 5 as extending side-to-side from one leg 452 to the other leg 454). The presence of the raised lug 488 renders the top wall 456 structurally bilaterally asymmetrical about the plane P2 so that opposite side-to-side orientations of the tab 450 may be easily distinguished.

To summarize, the structural bilateral asymmetry may be about either one of two mutually perpendicular planes, both of the planes being non-parallel (and preferably perpendicular) to the top wall of the tab. FIGS. 2 and 3 illustrate the asymmetry relative to a plane P1, while FIGS. 4 and 5 illustrate the asymmetry relative to a plane P2. The asymmetry may be found in a top wall (as illustrated in FIGS. 3 and 5) or in the depending legs (as illustrated in FIGS. 2 and 4). The bilateral asymmetry may also be relative to both of the two mutually perpendicular planes—for example, by combining features of tab embodiments 150 and/or 250 with features of tab embodiments 350 and/or 450, or as seen in tab 50' to be described below. Selection of the best structural bilateral asymmetry will depend upon such considerations as whether the discrimination between opposite side-to-side orientations will be done by automated equipment or personnel, the particular needs of the application, and the like. It will be appreciated that differing embodiments may be more or less susceptible to accidental or intentional removal of the tab from the tab holder of the hanger.

Notwithstanding the fact that the present invention renders opposite side-to-side orientations of the tab easily distinguishable from one another, the fact remains that, due to human error, it is to be expected that at least some of the tabs will be disposed on the tab holder of the hanger in the wrong orientation (i.e., the orientation which does not facilitate reading of the information provided by the tab). To overcome even this remaining margin of error, in a fifth embodiment of the present invention the first and second fingers of a tab extend under the ledge of the tab holder of the hanger to lock the tab body on the tab holder only when the tab is in a desired predetermined one of the opposite orientations. If an attempt is made to place the tab on the tab holder in the wrong orientation, the fingers will not extend under the ledges of the tab holder to lock the body on the tab holder. This failure to lock is easily sensed, and, in any case, with ordinary handling the tab will eventually fall off of the holder, thereby calling attention to the fact that replacement of the tab on the holder in the correct orientation is required.

Figure 6:
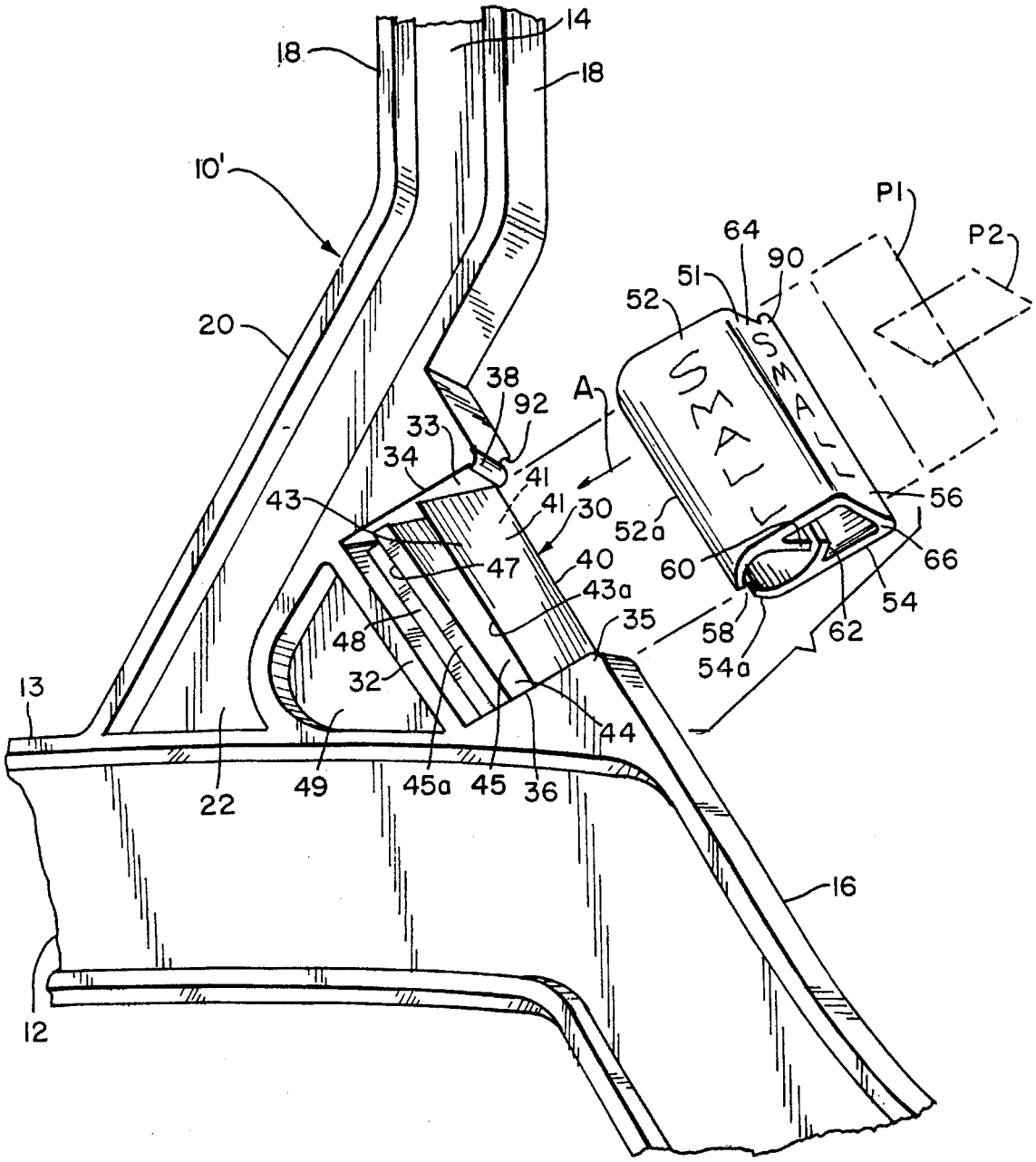
FIG. 6 is an exploded isometric view of a tab and hanger combination according to the present invention.

Referring now to FIG. 6, therein illustrated is a tab and hanger combination formed of a hanger 10' and tab 50' Except as specifically noted below, the hanger 10' and tab 50' are identical to the hanger 10 and tab 50 of the prior art illustrated in FIG. 1 and, accordingly, corresponding elements will be designated by like numerals.

The tab 50' includes, in addition to top wall 56, a top wall extension 90 which extends from one corner of the top wall 56 (as illustrated in FIG. 6, the upper right corner). The extension 90 has a thickness similar to that of the top wall 56 and, in particular, projects outwardly from the one side of the top wall 56. The hanger 10' includes, in addition to the cut-out region 38 adapted to receive the top wall 56, a 10 cut-out region extension 92 configured and dimensioned to receive the top wall extension 90 of tab 50'.

When the top wall extension 90 is seated in the cut-out region extension 92, the fingers 60, 62 are positioned to extend under the ledges 43a of the tab holder 30 to lock the tab body 51 on the tab holder 30. However, if the tab 50' is not in the appropriate side-to-side orientation relative to hanger 10' for the top wall extension 90 to be aligned with and seatable within the cut-out region extension 92, then the top wall extension 90 will be blocked by the transverse reinforcing wall or rib 16 on the other side so that the top wall 56 is not received within the cut-out region 38 and, accordingly, the fingers 60 and 62 do not extend downward sufficiently to be received beneath ledges **43*a* to lock the tab 50' to the hanger 10'. This non-seating of the top wall 56 in the cut-out region 38 and the non-receipt of the fingers 60, 62 under the ledges 43*a* is easily discernible both tactilely and visually, thereby signalling to the personnel or equipment involved that the tab 50' is to be removed from the hanger 10' and reapplied in the opposite side-to-side orientation. Even if the improper seating of the tab 50' on the hanger 10' is not detected, during normal handling of the combination the tab 50' will become displaced from the hanger 10'**, thereby signalling the need for its reapplication to the hanger in an appropriate orientation.

It will be appreciated that tab 50' is structurally bilaterally asymmetrical about both mutually perpendicular planes P1 and P2, although this is not a required feature of the fifth embodiment.

To summarize, the present invention provides a garment hanger information tab wherein the opposite side-to-side orientations of the tab may be distinguished and, in a preferred embodiment, wherein the tab will sit on the tab holder only in a predetermined side-to-side orientation. The tab is inexpensive to manufacture and use. The present invention also encompasses the combination of such a tab and a hanger.

Now that the preferred embodiments of the present invention have been shown and described in detail, various modifications and appurtenances thereon will become readily apparent to those skilled in the art. Accordingly, the spirit and scope of the present invention is to be construed broadly and limited only by the appended claims, and not by the foregoing specification.

I claim:

1. In a garment hanger information tab for use on a garment hanger having a tab holder, the tab holder including a ledge, said tab comprising a U-shaped body having a top wall, first and second sides, and first and second legs disposed between said sides and defining a slot and an internal channel therebetween, sa..id slot having a longitudinal axis, said body having first and second internal fingers extending inwardly from respective legs in said channel, said first and second fingers extending under the ledge of the tab holder to lock said body on the tab holder when said body is on the tab holder;

the improvement wherein said body is structurally bilaterally asymmetrical about both of two mutually perpendicular planes, both of said mutually perpendicular planes being perpendicular to said top wall, one of said mutually perpendicular planes being aligned with said slot longitudinal axis, and another of said mutually perpendicular planes being perpendicular to said slot longitudinal axis and bisecting said slot;

whereby opposite side-to-side orientations of said tab may be distinguished.

2. The tab of claim 1 wherein said first and second legs include free ends, the free ends of said legs extending inwardly to define a gap therebetween.

3. The tab of claim 1 wherein said top wall is structurally bilaterally asymmetrical about both of said two mutually perpendicular planes.

4. The tab of claim 1 wherein said legs are structurally bilaterally asymmetrical about both of said two mutually perpendicular planes.

5. The tab of claim 1 wherein said bilateral asymmetry enables said first and second fingers to extend under the ledge of the tab holder to lock said body on the tab holder only when said tab is in a predetermined one of said opposite orientations.

6. The tab of claim 5 wherein said top wall is structurally bilateral asymmetrical about both said two mutually perpendicular planes.

7. The tab of claim 6 for use with a tab holder defining at least a partial recess for receiving said top wall, said top wall being configured and dimensioned to be received within said recess only when said tab is in a predetermined one of said opposite orientations.

8. In combination, a garment hanger information tab and a garment hanger having a tab holder, (A) said tab holder comprising a ledge and defining at least a partial recess, (B) said tab comprising a U-shaped body having a hop wall, first and second sides, and first and second legs disposed between said sides and defining a slot and internal channel therebetween, said slot having a longitudinal axis, said body having first and second internal fingers extending inwardly from respective legs in said channel, said first and second fingers extending under said tab holder ledge to lock said body on said tab holder, said top wall being structurally bilaterally asymmetrical about both of two mutually perpendicular planes, both of said mutually perpendicular planes being perpendicular to said top wall, one of said mutually perpendicular planes being aligned with said slot longitudinal axis, and another of said mutually perpendicular planes being perpendicular to said slot longitudinal axis and bisecting said slot, said top wall being configured and dimensioned to be received within said recess only when said tab is in a predetermined one of opposite side-to-side orientations, said bilateral asymmetry enabling said first and second fingers to extend under said tab holder ledge to lock said body on said tab holder only when said tab is in said predetermined one of said opposite orientations enabling said top wall to be received within said recess.

9. In combination, a garment hanger information tab and a garment hanger having a tab holder, (A) said tab holder comprising a ledge, (B) said tab comprising a U-shaped body having a top wall, first and second sides, and first and second legs disposed between said sides and defining a slot and internal channel therebetween, said body having first and second internal fingers extending inwardly from respective legs in said channel, said first and second fingers extending under said tab holder ledge to lock said body on said tab holder, said body being structurally bilaterally asymmetrical about both of two mutually perpendicular planes, both of said mutually perpendicular planes being perpendicular to said top wall, said bilateral asymmetry enabling said first and second fingers to extend under the ledge of said tab holder to lock said body on said tab holder only when said tab is in a predetermined one of opposite side-to-side orientations.

10. The combination of claim 9 wherein said tab holder defines at least a partial recess for receiving said top wall, and said top wall is configured and dimensioned to be received within said recess only when said tab is in said predetermined one of said opposite orientations.

11. In combination, a garment hanger information tab and a garment hanger having a tab holder, (A) said tab holder comprising a ledge, (B) said tab comprising a U-shaped body having a top wall, first and second sides, and first and second legs disposed between said sides and defining a slot and internal channel therebetween, said body having first and second internal fingers extending inwardly from respective legs in said channel, said first and second fingers extending under said tab holder ledge to lock said body on said tab holder, said body being structurally bilaterally asymmetrical about both of two mutually perpendicular planes, both of said mutually perpendicular planes being perpendicular to said top wall, said bilateral asymmetry enabling recognition of the orientation of said tab in space without precluding said first and second fingers from extending under said ledge of said tab holder to lock said body on said tab holder.

12. In the combination of a garment hanger information tab and a garment hanger having a tab holder, (A) said tab holder including a ledge, and (B) said tab comprising a U-shaped body having a top wall, first and second sides, and first and second legs disposed between said sides and defining a slot and an internal channel therebetween, said body having first and second internal fingers extending inwardly from respective legs in said channel, said first and second fingers extending under the ledge of the tab holder to lock said body on the tab holder when said body is on the tab holder;

the improvement wherein said body is structurally bilaterally asymmetrical about both of two mutually perpendicular planes, both of said mutually perpendicular planes being perpendicular to said top wall;

whereby opposite side-to-side orientations of said tab may be distinguished.

* * * * *